US010221819B2

(12) United States Patent
Jung et al.

(10) Patent No.: US 10,221,819 B2
(45) Date of Patent: Mar. 5, 2019

(54) VARIABLE AIR INTAKE APPARATUS REDUCING NOISE

(71) Applicants: HYUNDAI MOTOR COMPANY, Seoul (KR); Kia Motors Corporation, Seoul (KR)

(72) Inventors: Doo-Seok Jung, Hwaseong-si (KR); Min-Chan Kwak, Jeonju-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/374,000

(22) Filed: Dec. 9, 2016

(65) Prior Publication Data

US 2018/0100472 A1 Apr. 12, 2018

(30) Foreign Application Priority Data

Oct. 6, 2016 (KR) ..... 10-2016-0128926

(51) Int. Cl.
*F02M 35/12* (2006.01)
*F02D 9/02* (2006.01)

(52) U.S. Cl.
CPC ..... *F02M 35/1222* (2013.01); *F02D 9/02* (2013.01); *F02M 35/1272* (2013.01); *F02D 2009/023* (2013.01); *F02D 2009/0205* (2013.01)

(58) Field of Classification Search
CPC ..... F02M 35/1222; F02M 35/1272; F02M 35/1205; F02M 35/1211; F02M 35/12; F02M 35/1227; F02D 9/02; F02D 2009/023
See application file for complete search history.

(56) References Cited

U.S. PATENT DOCUMENTS 6,209,503 B1 * 4/2001 Komada ..... F02M 35/10013 123/184.56

FOREIGN PATENT DOCUMENTS

| | | | |
|---|---|---|---|
| JP | 2000-145559 | A | 5/2000 |
| JP | 2002235545 | A | 8/2002 |
| JP | 2004197656 | A | 7/2004 |
| JP | 2011-137431 | A | 7/2011 |
| KR | 2011-0052918 | A | 5/2011 |
| KR | 2011-0119944 | A | 11/2011 |
| KR | 20130099506 | A | 9/2013 |
| KR | 20-0477778 | Y1 | 7/2015 |

* cited by examiner

*Primary Examiner* — Jacob Amick
(74) *Attorney, Agent, or Firm* — McDonnell Boehnen Hulbert & Berghoff LLP

(57) ABSTRACT

A variable air intake apparatus in accordance with the present invention includes an valve configured to open a through hole formed at a duct body when an engine is driven at a high output to change a path of air introduced into the engine depending on an engine RPM, in which a magnet is mounted on any one of the valve and the duct body and a steel member is mounted on the other one thereof to maintain a state in which the valve closes the through hole, and a buffering member is mounted on any one of the valve and the duct body to prevent generation of hitting sound that is generated when the valve hits the duct body.

16 Claims, 5 Drawing Sheets

VARIABLE AIR INTAKE APPARATUS REDUCING NOISE

CROSS-REFERENCE TO RELATED APPLICATIONS

This application claims benefit of and priority to Korean Patent Application No. 2016-0128926, filed on Oct. 6, 2016, which is incorporated herein by reference in its entirety.

BACKGROUND OF THE INVENTION

Field of the Invention

Example embodiments of the present disclosure relate to a variable air intake apparatus installed in an vehicle air intake duct to change an air flow path depending on an engine RPM, and more particularly, to a noise-reducing variable air intake apparatus that prevents generation of a sound when a valve hits one side of a duct body while opening or closing at the time of rapid reduction in the engine RPM.

Description of Related Art

A variable air intake system in which air introduced into an engine may have different paths depending on an engine RPM is known.

In the variable air intake system, when a vehicle engine is operated at a low RPM, the path by which the air is introduced from the outside of the vehicle to the engine is lengthened to improve noise, vibration, and harshness ("NVH"). When the engine is operated at a high RPM, the path by which the air is introduced from the outside of the vehicle to the engine is shortened so that a large amount of air can be smoothly introduced into the engine to facilitate high engine output.

To this end, as illustrated in FIG. 1 or 2, a valve 120 is installed in an air duct body 111, such that the air duct body 111 is selectively opened depending on the engine RPM.

As shown in FIG. 1, when the engine RPM is low, valve 120 is closed and air flowing through air duct 112 passes through the duct body 111 into the engine. Thus the air path to the engine is lengthened, thereby eliminating noise (see FIG. 1).

As shown in FIG. 2, when the engine RPM is high, valve 120 is opened due to negative pressure, and air is directly introduced from outside the vehicle into duct body 111, such that air flow into the engine becomes smooth, and output of the engine is increased (see FIG. 2).

A magnetic closure may be used to maintain valve 120 in a closed position at a side surface of the duct body 111. When the amount of air introduced into the engine is increased and pressure in the duct body 111 is correspondingly decreased, the force of the pressure differential exceeds the magnetic force of the closure and valve 120 is opened.

Under normal driving conditions, when the output of the engine is decreased, the amount of air flowing in the duct body 111 gradually decreases, valve 120 closes slowly and no sound is generated from the valve contacting the duct body. However, when the amount of air flowing in the duct body 111 rapidly decreases (e.g. when sudden braking occurs), valve 120 rapidly closes and hits the duct body 111, generating a noticeable hitting sound.

To maintain valve 120 in a closed position, a magnet may be mounted on either the valve 120 or the duct body 111 and a steel member may be mounted on the other one. In this case, magnetic forces may increase the force with which valve 120 hits duct body 111, generating a louder hitting sound.

SUMMARY OF THE INVENTION

An example embodiment according to the present disclosure provides a variable air intake apparatus that reduces noise by preventing generation of a hitting sound when a valve installed at one side of an air intake duct hits a duct body at the time of a rapid change in an engine output from high output to low output.

Other objects and advantages of the present disclosure can be understood by reference to the following description, and in particular by reference to the example embodiments described herein. Also, it is obvious to those skilled in the art to which the present disclosure pertains that the specified objects and advantages can be realized by the means as claimed and combinations thereof.

In accordance with an example embodiment, a variable air intake apparatus comprises a valve that controls an air flow path by covering or uncovering a through hole in a duct body depending on an engine RPM; a magnet mounted on either the valve or the duct body; a steel member mounted on the one of the valve and the duct body to which the magnet is not mounted; and a buffering member mounted on either the valve or the duct body to prevent generation of hitting sound when the valve rapidly closes and hits the duct body.

The magnet and the buffering member may be mounted at positions spaced apart from each other.

The valve may include a valve body having an upper portion closing the through hole formed at a side surface of the duct body, and an upper end of the body may be coupled to the duct body so that the valve rotates toward the inside of the duct body.

A lower portion of the valve body may be inclined with respect to the valve body, and when the valve closes the through hole, the inclined section may be disposed adjacent to an inclined surface of the duct body while maintaining a predetermined spacing therebetween.

The magnet may be mounted on the inclined section of the valve body, and the steel member may be mounted on the inclined surface of the duct body.

The steel member may be mounted at a position directly under the magnet while being spaced apart from the magnet.

The valve may include a buffering part extending from a lower end of the inclined part, and a buffering member may be attached on the buffering part.

The duct body may include a buffering surface contacting the buffering member when the valve closes the through hole.

The valve body and the buffering part may parallel to each other.

The buffering member may be composed of a rubber material, including an ethylene propylene diene monomer (EPDM).

DESCRIPTION OF SPECIFIC EMBODIMENTS

Figure 1:
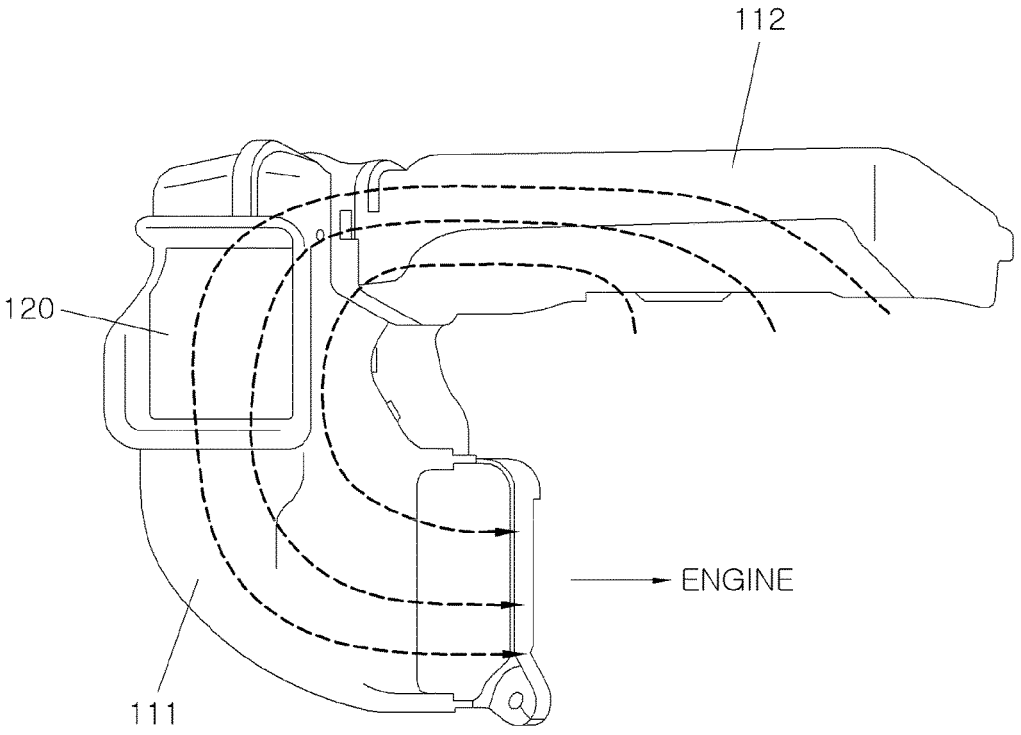
FIG. 1 is a perspective view illustrating air flow in a variable air intake system according to the related art when the valve is closed.
Figure 2:
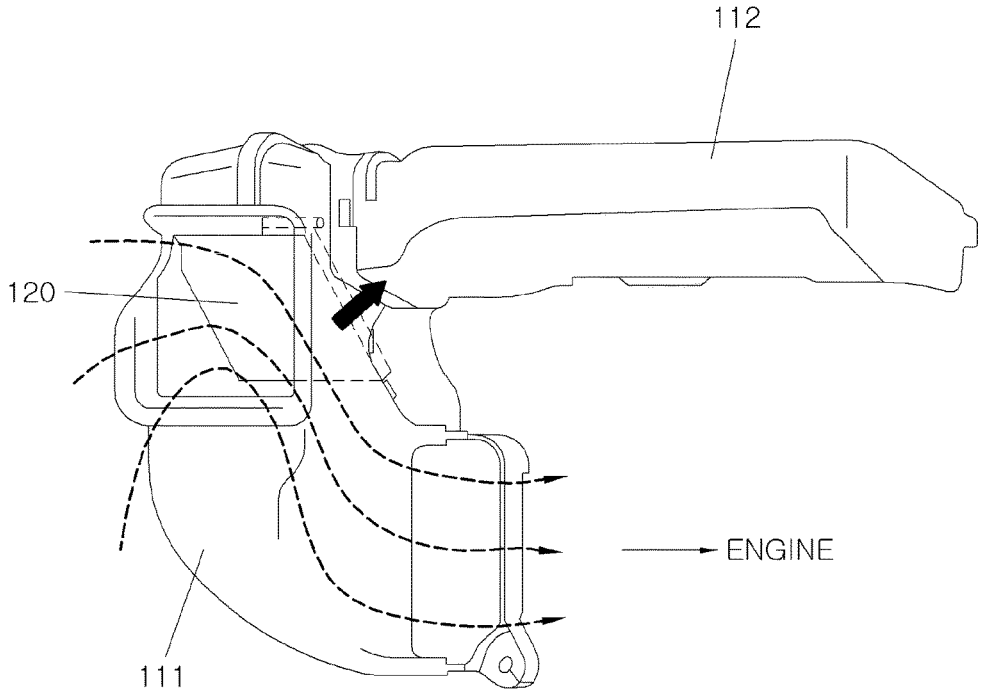
FIG. 2 is a perspective view illustrating air flow in the variable air intake system according to the related art when the valve is opened.
Figure 3:
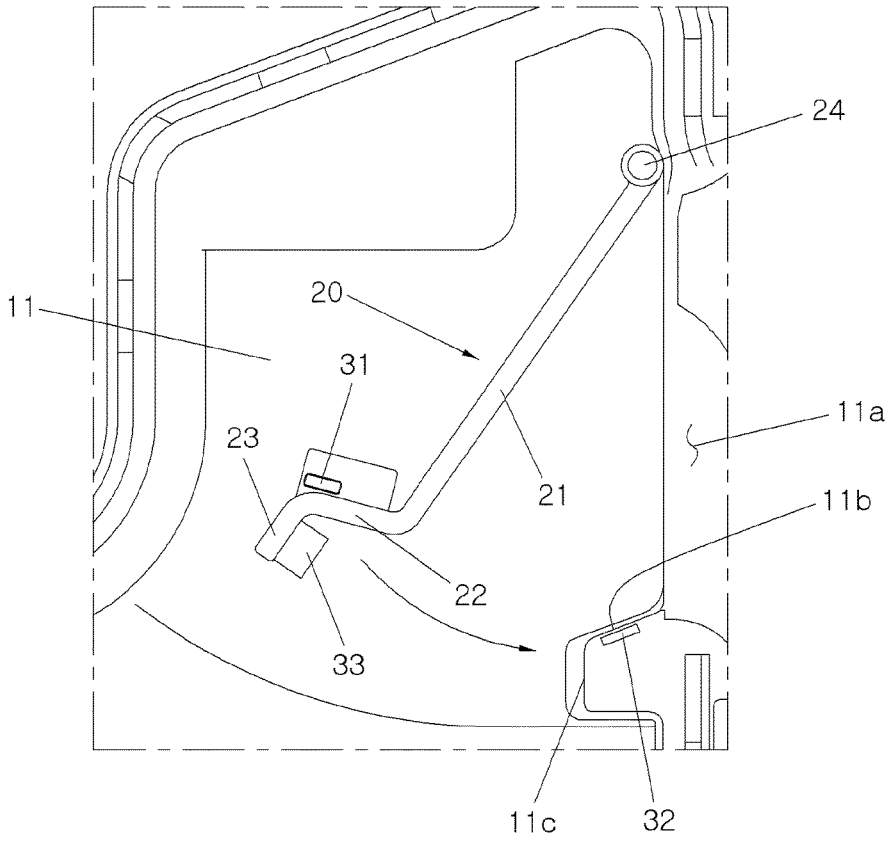
FIG. 3 is a cross-sectional view illustrating an open valve in an example embodiment of a noise-reducing variable air intake apparatus.

Hereinafter, a noise-reducing variable air intake apparatus is described in detail with reference to the accompanying drawings.

In an example embodiment of a noise-reducing variable air intake apparatus, a magnet 31 is mounted on either a valve 20 or a duct body 11, and a steel member 32 is mounted on the other one of valve 20 and duct body 11 to maintain valve 20 in position closing a through hole 11*a* of the duct body 11. A buffering member 33 preventing generation of sound when valve 20 hits the duct body 11 as it closes is mounted on either valve 20 or duct body 11.

Air duct 12 serves as an inlet through which fresh air is introduced from the outside of the vehicle. Air duct 12 includes a channel for air flow, and, depending on the operating conditions of the vehicle, air may pass through the channel in air duct 12 into an engine, thereby reducing engine noise.

Duct body 11 is installed between air duct 12 and an air cleaner. Air introduced into duct body 11 passes through the air cleaner and is then introduced into the engine.

When the engine is driven at a low RPM, valve 20 is closed and air is introduced into duct body 11 through air duct 12. When the engine is driven at a high RPM, valve 20 is open and air is directly introduced into duct body 11 from the outside the vehicle.

A through hole 11*a* is formed at one side of duct body 11 so that air may be directly introduced into duct body 11 from outside the vehicle.

Valve 20 is installed so as to selectively open and close through hole 11*a*. When valve 20 closes through hole 11*a* of duct body 11, fresh air is introduced into duct body 11 through air duct 12. When valve 20 opens through hole 11*a*, fresh air is directly introduced into duct body 11 from outside the vehicle.

When the amount of air introduced into duct body 11 increases as engine RPM increases, and duct body 11 has negative pressure in it, valve 20 opens toward an inner side of duct body 11.

Valve 20 has a shape corresponding to the shape of through hole 11*a* in duct body 11, and includes a valve body 21 that opens and closes through hole 11*a*, an inclined section 22 extending downward from a lower end of valve body 21 and inclined with respect to valve body 21, and a buffering part 23 extending from a lower end of inclined section 22. An upper end of valve body 21 is coupled to duct body 11 through a hinge shaft 24, allowing valve 20 to rotate in order to open and close through hole 11*a*. Inclined part 22 is inclined toward the inner side of duct body 11 at the lower end of the body 21. Buffering part 23 is inclined with respect to inclined section 22 at the lower end of inclined section 22, and is substantially in parallel with valve body 21.

Figure 4:
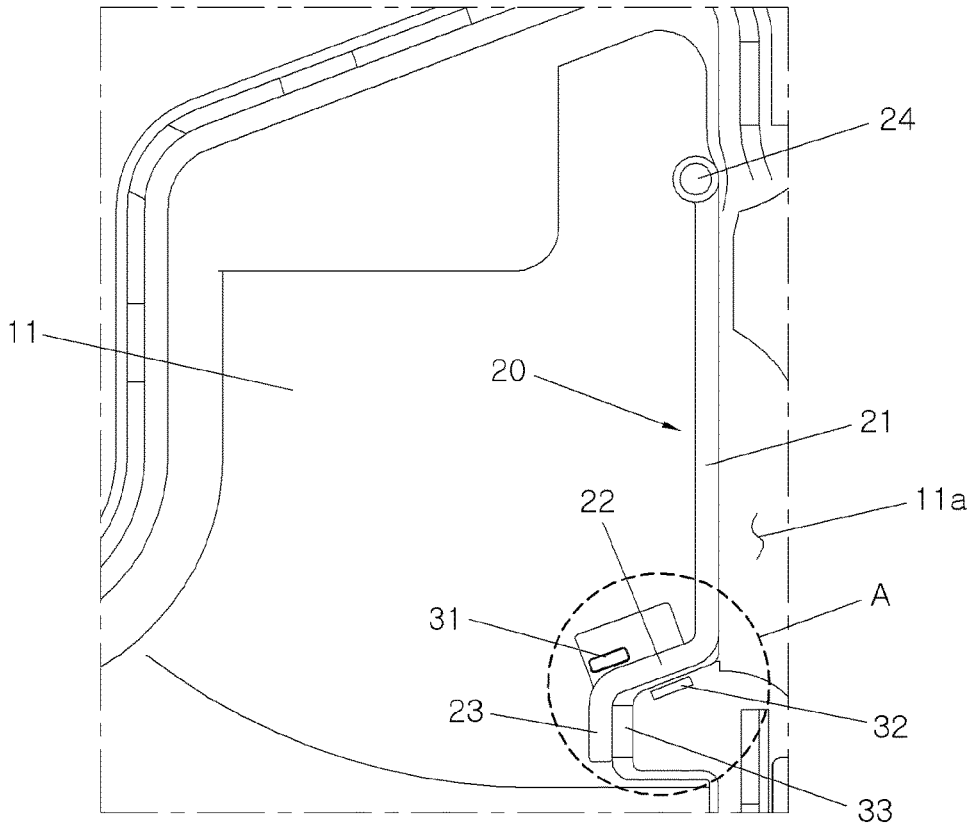
FIG. 4 is a cross-sectional view illustrating a closed valve in an example embodiment of a noise-reducing variable air intake apparatus.

Duct body 11 further comprises an inclined surface 11*b* and a buffering surface 11*c* disposed at a lower side of inclined surface 11*b*. When valve 20 closes through hole 11*a*, as shown in FIG. 4, inclined section 22 of valve body 21 is positioned adjacent to and parallel to inclined surface 11*b*, or is seated on inclined surface 11*b*, and buffering member 23 is positioned adjacent to or is in contact with buffering surface 11*c*. Preferably, inclined section 22 is positioned adjacent to inclined surface 11*b*, and the buffering part 23 is positioned adjacent to buffering surface 11*c*. In a further example embodiment, the spacing between inclined section 22 and inclined surface 11*b* is about 0.5 mm.

Buffering member 33 prevents generation sound when valve body 21 hits the inside of duct body 11 while closing through hole 11*a*. Buffering member 33 may be mounted on one of valve 20 and duct body 11.

Example mounting positions of magnet 31, steel member 32, and buffering member 33 on valve 20 or duct body 11 are described below in detail.

Magnet 31 is mounted on one of valve 20 and duct body 11, and the steel member 32 is mounted on the other one of valve 20 and duct body 11. Preferably, the magnet 31 is mounted on valve 20 and steel member 32 is mounted on duct body 11. In this configuration, steel member 32 is mounted at a position directly under magnet 31 while being spaced apart from magnet 31.

When the pressure difference between the inside and the outside of duct body 11 is small, magnetic force acting between the magnet 31 and the steel member 32 causes valve 20 to closely adhere to duct body 11 to close through hole 11*a* of duct body 11. In contrast, when the pressure difference between the inside and the outside of duct body 11 is large, the force applied on valve body 21 exceeds and overcomes the magnetic force, such that valve 20 is opened.

Mounting magnet 31 on inclined section 22 of valve body 21 and steel member 32 on inclined surface 11*b* of duct body 11 creates magnetic forces in a direction different from the direction in which valve 20 hits duct body 11.

Buffering member 33 is mounted at a position spaced apart from magnet 31. If buffering member 22 is mounted at a position overlapping magnet 31 or steel member 32, the effectiveness of buffering member 33 may deteriorate due to repeated of opening and closing of the valve 20, and an associated loss of both thickness of buffering member 33 and the recovery force associated with buffering member 33. Therefore, in the example embodiments described herein, buffering member 33 is mounted at the position spaced apart from the magnet 31. Thus, in an example embodiment, buffering member 33 is mounted on the buffering part 23 or the buffering surface 11*c*, preferably, the buffering part 23.

Because the magnetic force acting between magnet 31 and steel member 32 is in inverse proportion to the square of the distance between them, in order to maintain valve 20 in a closed position, magnet 31 and steel member 32 need to be kept at a minimum predetermined distance. If buffering member 33 is positioned at the same position as the magnet 31, as the thickness of buffering member 33 decreases due wear from repeated opening and closing of valve 20 the distance between magnet 31 and steel member 32 decreases. As a result, the magnetic force between magnet 31 and steel member 32 increases and the opening timing of valve 20 correspondingly increases. However, by mounting buffering member 33 at a position spaced apart from magnet 31, even if the thickness of buffering member 33 decreases, so long as the distance between magnet 31 and steel member 32 is maintained, the buffering force may not deteriorate.

Buffering member 33 may be composed of a rubber material, preferably, ethylene propylene diene monomer (EPDM).

Operation of the noise-reducing variable air intake apparatus in the foregoing example configuration is described in detail below.

When the engine is operated at a low RPM (low output), because the pressure difference between the inside and the outside of duct body 11 is low, the force applied to valve 20 by the pressure differential does not exceed the magnetic force acting between magnet 31 and steel member 32, and thus valve 20 closes through hole 11*a*. Fresh air flows through air duct 12, duct body 11, and the air cleaner and into the engine. The air flow path is lengthened, thereby decreasing the combustion noise of the engine.

When the engine is operated at a high RPM (high output), the pressure in duct body 11 is very low, and thus the pressure differential between the inside and the outside of duct body 11 increases. The force applied to valve 20 by the pressure differential between the inside and the outside of duct body 11 exceeds the magnetic force acting between magnet 31 and steel member 32, causing valve 20 to opens and uncover through hole 11*a*. The amount of air flowing into duct body 11 through through hole 11*a* from the outside of duct body 11 increases, thereby increasing the engine output.

If the amount of air is rapidly decreased, as happens when there is a sudden braking of the vehicle, valve 20 drops due to its own weight, hits duct body 11 and closes the through hole 11*a*. Just before valve 20 closes the through hole 11*a*, the magnetic force also acts to pull magnet 31 and steel member 32 towards each other. Buffer part 23 of valve 20 hits buffering surface 11*c*. Because buffering member 33 is mounted on buffering part 23, buffering member 33 prevents generation of sound resulting from valve 20 hitting the inside of duct body 11.

Furthermore, by making the direction of the magnetic force acting between magnet 31 and steel member 32 different from the direction in which valve 20 hits duct body 11, the effect of the magnetic force in increasing the force with which valve 20 hits the inside of duct body 11 is attenuated.

Figure 5:
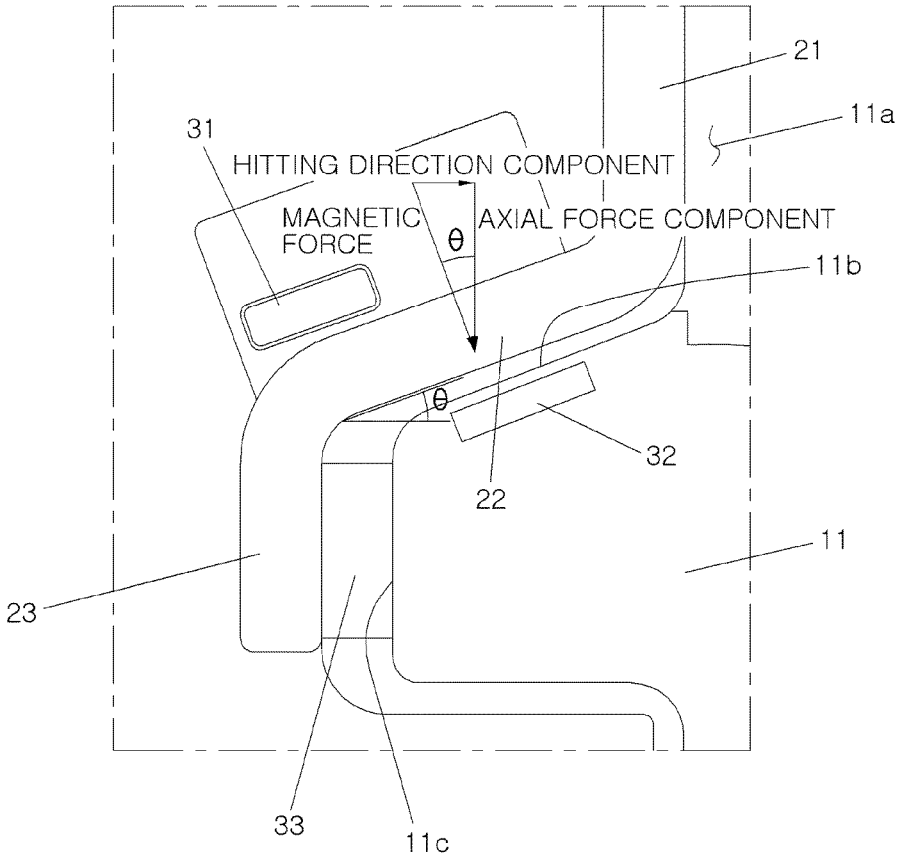
FIG. 5 is an enlarged view of part A of FIG. 4.

As shown in in FIG. 5, the angle θ between magnet 31 and valve body 21, results in only sin θ of the magnetic force acting in the direction of valve 20 hitting the inside of duct body 11. The presence of inclined section 22 and inclined surface 11*b* causes only some of the magnetic force to act in the same direction as that of valve 20 hitting the inside of duct body 11. Most of the magnetic force instead acts in a vertical direction (axial force component), and thus the force used for maintaining valve 20 in a closed position is only slightly decreased.

The noise-reducing variable air intake apparatus having the configuration described above solves the problem of sound generated by the valve hitting the inside of the duct body when engine output is decreased by using a buffering member attached on the valve.

In particular, because the buffering member is attached to the valve body at a position spaced apart from the magnet, it is possible to prevent the recovering force of the buffering member from deteriorating due to wear from continued use. Therefore, it is possible to prevent the generation of a hitting sound due to the decreased recovering force of the buffering member, even when the buffering member has been in use for a long period of time.

Further, because the magnet is mounted on an inclined surface of the valve, the direction in which the magnetic force acts and the direction in which the valve hits the duct body are different from each other, such that the magnetic force at the moment that the valve hits the duct body is weakened, but the magnetic force keeping the valve closed is maintained at the same level as the related art.

What is claimed is:

1. A noise-reducing variable air intake apparatus, comprising:

a duct body having a through hole;

a valve having a valve body disposed in the duct body;

a magnet mounted on one of the duct body and the valve body;

a steel member disposed on the other one of the duct body and the valve body; and a buffering member mounted on one of the valve body and duct body;

wherein, when a vehicle is driven at high revolutions per minute, the valve closes so that the valve body blocks the through hole in the duct body, and wherein, when the valve closes, the buffering member prevents generation of sound when the valve body hits the duct body.

2. The noise-reducing variable air intake apparatus of claim 1, wherein the magnet and the buffering member are spaced apart from each other.

3. The noise-reducing variable air intake apparatus of claim 1, wherein the valve body comprises an upper section that closes the through hole in the duct body, and wherein the upper section of the valve body is coupled to the duct body allowing the valve to rotate inside the duct body.

4. A noise-reducing variable air intake apparatus, comprising:

a duct body having a through hole;

a valve having a valve body disposed in the duct body;

a magnet mounted on one of the duct body and the valve body;

a steel member disposed on the other one of the duct body and the valve body; and a buffering member mounted on one of the valve body and duct body;

wherein the valve body further comprises an inclined section extending from an end of the upper section of the valve body, and wherein the duct body further comprises an inclined surface, such that when the valve closes the through hole, the inclined section is disposed adjacent to, but is not touching, the inclined surface; and wherein, when a vehicle is driven at high revolutions per minute, the valve closes so that the valve body blocks the through hole in the duct body, and wherein, when the valve closes, the buffering member prevents generation of sound when the valve body hits the duct body.

5. The noise-reducing variable air intake apparatus of claim 4, wherein the spacing between the inclined section of the valve body and the inclined surface of the duct body is about 0.5 mm.

6. The noise-reducing variable air intake apparatus of claim 4, wherein the magnet is mounted on the inclined section of the valve body, and the steel member is mounted on the inclined surface of the duct body.

7. The noise-reducing variable air intake apparatus of claim 6, wherein the steel member is mounted at a position directly under the magnet while being spaced apart from the magnet.

8. The noise-reducing variable air intake apparatus of claim 6, wherein the valve further comprises a buffering part extending from a lower end of the inclined section, and the buffering member is attached on the buffering part.

9. The noise-reducing variable air intake apparatus of claim 8, wherein the duct body further comprises a second buffering surface, wherein when the valve closes, the buffering member contacts the second buffering surface.

10. The noise-reducing variable air intake apparatus of claim 8, wherein the valve body and the buffering part are parallel to each other.

11. The noise-reducing variable air intake apparatus of claim 1, wherein the buffering member is composed of a rubber material.

12. The noise-reducing variable air intake apparatus of claim 10, wherein the buffering member is composed of ethylene propylene diene monomer.

13. The noise-reducing variable air intake apparatus of claim 4, wherein the magnet and the buffering member are spaced apart from each other.

14. The noise-reducing variable air intake apparatus of claim 4, wherein the valve body comprises an upper section that closes the through hole in the duct body, and wherein the upper section of the valve body is coupled to the duct body allowing the valve to rotate inside the duct body.

15. The noise-reducing variable air intake apparatus of claim 4, wherein the buffering member is composed of a rubber material.

16. The noise-reducing variable air intake apparatus of claim 4, wherein the buffering member is composed of ethylene propylene diene monomer.

* * * * *